US007068292B2

(12) United States Patent
Morita

(10) Patent No.: US 7,068,292 B2
(45) Date of Patent: Jun. 27, 2006

(54) DISPLAY DRIVER CIRCUIT, DISPLAY PANEL, DISPLAY DEVICE, AND DISPLAY DRIVE METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 455 days.

(21) Appl. No.: 10/354,061

(22) Filed: Jan. 30, 2003

(65) Prior Publication Data

US 2003/0156104 A1 Aug. 21, 2003

(30) Foreign Application Priority Data

Feb. 14, 2002 (JP) ..... 2002-036693

(51) Int. Cl.
*G09G 5/10* (2006.01)

(52) U.S. Cl. ..... 345/690; 345/89; 345/692

(58) Field of Classification Search ..... 345/690–696, 345/89, 98, 589, 698, 596
See application file for complete search history.

(56) References Cited

U.S. PATENT DOCUMENTS

| | | | | |
|---|---|---|---|---|
| 5,617,111 | A | 4/1997 | Saitoh | |
| 5,774,106 | A * | 6/1998 | Nitta et al. | 345/98 |
| 5,952,789 | A | 9/1999 | Stewart et al. | |
| 6,127,997 | A | 10/2000 | Tsuchi | |
| 6,232,948 | B1 | 5/2001 | Tsuchi | |
| 6,522,319 | B1 * | 2/2003 | Yamazaki | 345/103 |
| 6,856,308 | B1 * | 2/2005 | Akimoto et al. | 345/98 |

FOREIGN PATENT DOCUMENTS

| | | | |
|---|---|---|---|
| EP | 0 947 975 | A1 | 10/1999 |
| EP | 1 091 432 | A2 | 4/2001 |
| EP | 1 094 440 | A2 | 4/2001 |
| JP | A 2-127618 | | 5/1990 |
| JP | A 2-204718 | | 8/1990 |
| JP | A 4-125688 | | 4/1992 |
| JP | A 8-6524 | | 1/1996 |
| JP | A 10-105124 | | 4/1998 |
| JP | A 2000-66640 | | 3/2000 |
| JP | 2003-241717 | | 8/2003 |
| TW | 473628 | | 3/1997 |
| TW | 473641 | | 2/2002 |

OTHER PUBLICATIONS

Furuhashi et al., "23.4: A 64-Gray-Scale Digital Signal Driver for Color TFT-LCDs", SID International Symposium Digest of Technical Papers, vol. 25, pp. 359-362, 1994.

* cited by examiner

*Primary Examiner*—Ricardo Osorio
(74) *Attorney, Agent, or Firm*—Oliff & Berridge, PLC

(57) ABSTRACT

A signal driver IC (or a display driver circuit in a broad sense) includes a signal electrode driver circuit which drives a signal electrode by using grayscale data. The signal electrode driver circuit has a precharge circuit, a DAC circuit, and a drive voltage adjusting circuit. The precharge circuit sets an output electrode connected to the signal electrode at a precharge voltage in a first stage which is a first period within one horizontal scanning period. In a second stage subsequent to the first stage, the DAC circuit sets the output electrode at a reference voltage based on the grayscale data. In a third stage subsequent to the second stage, the drive voltage adjusting circuit adjusts the voltage of the output electrode by using the grayscale data.

18 Claims, 15 Drawing Sheets

| GRAYSCALE DATA | | | | | | TARGET VOLTAGE | ADJUSTMENT PULSE |
|---|---|---|---|---|---|---|---|
| D5 | D4 | D3 | D2 | D1 | D0 | Vx | ADJUSTMENT DIRECTION/ PULSE WIDTH |

| GRAYSCALE DATA | | | | | | TARGET VOLTAGE | ADJUSTMENT PULSE |
|---|---|---|---|---|---|---|---|
| D5 | D4 | D3 | D2 | D1 | D0 | Vx | ADJUSTMENT DIRECTION/ PULSE WIDTH |

FIG. 11

| GRAYSCALE DATA | | | | | | TARGET VOLTAGE | GAMMA-CORRECTION VOLTAGE |
|---|---|---|---|---|---|---|---|
| D5 | D4 | D3 | D2 | D1 | D0 | Vx | $V\gamma x$ |

DISPLAY DRIVER CIRCUIT, DISPLAY PANEL, DISPLAY DEVICE, AND DISPLAY DRIVE METHOD

Japanese Patent Application No. 2002-36693, filed on Feb. 14, 2002, is hereby incorporated by reference in its entirety.

BACKGROUND OF THE INVENTION

The present invention relates to a display driver circuit, a display panel, a display device, and a display drive method.

In recent years, a thin film transistor (hereinafter abbreviated as "TFT") liquid crystal device has been used as a display device for a portable electronic instrument represented by a portable telephone. Therefore, reduction in power consumption of a TFT liquid crystal device is demanded.

BRIEF SUMMARY OF THE INVENTION

According to a first aspect of the present invention, there is provided a display driver circuit for driving a signal electrode based on grayscale data of (a+b) bits (a and b are positive integers), the display driver circuit comprising:

a precharge circuit which sets an output electrode electrically connected to the signal electrode at a precharge voltage in a first period within a drive period;

a voltage select circuit which sets the output electrode which has been set at the precharge voltage at a reference voltage based on the grayscale data; and a drive voltage adjusting circuit which adjusts a voltage of the output electrode by using the grayscale data, the output voltage having been set at the reference voltage.

According to a second aspect of the present invention, there is provided a display drive method for driving a signal electrode based on grayscale data of (a+b) bits (a and b are positive integers), the display drive method comprising:

setting an output electrode electrically connected to the signal electrode at a precharge voltage in a first period within a drive period;

setting the output electrode which has been set at the precharge voltage at a reference voltage based on the grayscale data; and adjusting a voltage of the output electrode by using the grayscale data, the output electrode having been set at the reference voltage.

BRIEF DESCRIPTION OF THE SEVERAL VIEWS OF THE DRAWING

FIG. 11 is a diagram illustrative of the relationship among grayscale data, a target voltage in a second stage and a gate signal in a third stage according to the second embodiment.

DETAILED DESCRIPTION OF THE EMBODIMENT

Figure 1:
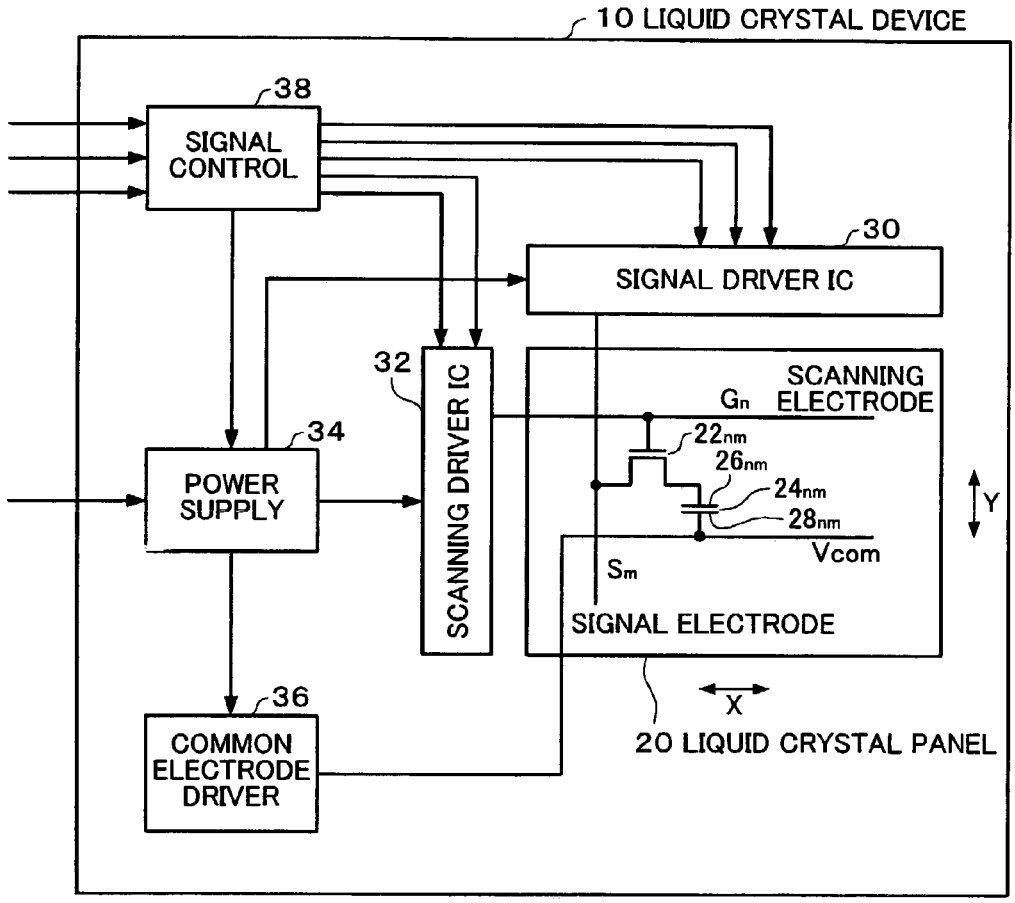
FIG. 1 is a diagram schematically showing configuration of a liquid crystal device.

Embodiments of the present invention are described below. Note that the embodiments described below do not in any way limit the scope of the invention defined by the claims laid out herein. Similarly, all the elements described below should not be taken as essential requirements of the present invention.

A display driver circuit for driving a TFT liquid crystal device drives a signal electrode connected to a TFT (pixel switch element in a broad sense) disposed in a pixel by using a voltage follower connected operational amplifier. Although this enables high drive capability to be obtained, it is difficult to reduce the power consumption since a current has be flown constantly through the operational amplifier.

The following embodiments may provide a display driver circuit, a display panel, a display device, and a display drive method all of which are capable of reducing the power consumption by reducing an amount of constantly flowing current.

According to one embodiment of the present invention, there is provided a display driver circuit for driving a signal electrode based on grayscale data of (a+b) bits (a and b are positive integers), the display driver circuit comprising:

a precharge circuit which sets an output electrode electrically connected to the signal electrode at a precharge voltage in a first period within a drive period;

a voltage select circuit which sets the output electrode which has been set at the precharge voltage at a reference voltage based on the grayscale data; and a drive voltage adjusting circuit which adjusts a voltage of the output electrode by using the grayscale data, the output voltage having been set at the reference voltage.

In this configuration, the voltage to be supplied to the signal electrode during the drive period is set at the precharge voltage by the precharge circuit, then roughly set at the reference voltage based on the grayscale data by the voltage select circuit, and adjusted by the drive voltage adjusting circuit. Therefore, a target grayscale voltage can be applied to the signal electrode without using an operational amplifier. This enables to reduce the consumption ot a current constantly flowing through the operational amplifier, leading to the reduction of power consumption of the display driver circuit.

In this display driver circuit, the voltage select circuit may set the output electrode at the reference voltage based on high order "a" bit(s) in the grayscale data of (a+b) bits.

This enables to use the high order "a" bit(s) to roughly divide grayscale determined based on the grayscale data of (a+b) bits. For example, high order four bits in grayscale data can be used to divide grayscale levels determined based on grayscale data of six bits into 16 levels.

This display driver circuit which is capable of applying a target grayscale voltage to the signal electrode without using an operational amplifier can reduce the number of types of reference voltages provided in advance, as described, enabling to simplify the configuration.

In this display driver circuit, the drive voltage adjusting circuit may include a first transistor and a second transistor; a source terminal and a drain terminal of the first transistor may be respectively connected to a first power supply line to which a first power supply voltage is supplied and the output electrode; a source terminal and a drain terminal of the second transistor may be respectively connected to a second power supply line to which a second power supply voltage is supplied and the output electrode; and a gate signal may be applied to a gate electrode of one of the first and second transistors, the gate signal having a pulse width determined based on low order "b" bit(s) or the low order "b" bit(s) and at least part of high order "a" bit(s) in the grayscale data of (a+b) bits.

In this configuration, since the drive voltage adjusting circuit has the first and second transistors connected between the first and second power supply lines and the output electrode, the PWM control by the first or second transistor enables to set a target grayscale voltage with high accuracy according to the load to the capacitive output electrode and grayscale characteristics of the display panel.

In this display driver circuit, the drive voltage adjusting circuit may include at least one transistor for gamma correction; a source terminal and a drain terminal of the transistor for gamma correction may be respectively connected to a signal line to which a gamma-corrected voltage is supplied and the output electrode; and a gate signal generated based on the grayscale data of (a+b) bits may be applied to a gate electrode of the transistor for gamma correction.

The transistor for gamma correction is provided between the signal line to which the gamma-corrected voltage is supplied and the output electrode, and the transistor for gamma correction is controlled based on the grayscale data. Therefore, a voltage of the output electrode set at the reference voltage can be gamma-corrected by digital transistor control. As a result, a period in which the gamma-corrected voltage is driven can be shortened, leading to the simplification of the configuration.

In this display driver circuit, the drive voltage adjusting circuit may include a first transistor, a second transistor and at least one transistor for gamma correction; a source terminal and a drain terminal of the first transistor may be respectively connected to a first power supply line to which a first power supply voltage is supplied and the output electrode; a source terminal and a drain terminal of the second transistor may be respectively connected to a second power supply line to which a second power supply voltage is supplied and the output electrode; a source terminal and a drain terminal of the transistor for gamma correction may be respectively connected to a signal line to which a gamma-corrected voltage is supplied and the output electrode; a gate signal may be applied to a gate electrode of one of the first and second transistors, the gate signal having a pulse width determined based on low order "b" bit(s) or the low order "b" bit(s) and at least part of high order "a" bit(s) in the grayscale data of (a+b) bits; and another gate signal generated based on the grayscale data of (a+b) bits may be applied to a gate electrode of the transistor for gamma correction.

In this configuration, a voltage to be supplied to the signal electrode during the drive period is set at the precharge voltage by the precharge circuit, then roughly set at the reference voltage based on the grayscale data by the voltage select circuit, and adjusted by the drive voltage adjusting circuit. Moreover, the transistor for gamma correction is provided between the signal line to which the gamma-corrected voltage is supplied and the output electrode, and the transistor for gamma correction is controlled based on the grayscale data. This enables to apply a target grayscale voltage to the signal electrode without using an operational amplifier. Therefore, consumption ot a current constantly flowing through an operational amplifier can be reduced, leading to reduction of power consumption by the display driver circuit. Moreover, a voltage of the output electrode can be gamma-corrected by digital transistor control.

In this display driver circuit, a pixel electrode may be connected to the signal electrode which is electrically connected to the output electrode, through a pixel switch element corresponding to a pixel; and the precharge voltage may be a voltage in the same phase as a voltage of an electrode opposite to the pixel electrode.

The precharge voltage is a voltage in the same phase as the voltage of the electrode opposite to the pixel electrode, but does not need to be equal to the voltage of the electrode opposite to the pixel electrode. The precharge voltage may include a voltage having a value which is slightly different from one of the first or second power supply voltage.

This configuration can be multi-purposely applied to a display drive circuit used for general polarity inversion drive since this configuration enables to keep an absolute value of an applied voltage between the pixel electrode and the electrode opposite to the pixel electrode and to change only polarity of the voltage, leading to the reduction of power consumption.

According to one embodiment of the present invention, there is provided a display panel comprising:

pixels specified by a plurality of scanning electrodes and a plurality of signal electrodes;

the above-described display driver circuit for driving the signal electrodes based on grayscale data; and a scanning electrode driver circuit which scans the scanning electrodes.

In this configuration, since an operational amplifier is not used in the display driver circuit which drives the signal electrodes, power consumption of the display panel including the display driver circuit can be reduced.

According to one embodiment of the present invention, there is provided a display device comprising:

a display panel having pixels specified by a plurality of scanning electrodes and a plurality of signal electrodes;

the above-described display driver circuit for driving the signal electrodes based on grayscale data; and a scanning electrode driver circuit which scans the scanning electrodes.

In this configuration, since an operational amplifier is not used in the display driver circuit which drives the signal electrodes, power consumption of the display device including the display driver circuit can be reduced.

According to one embodiment of the present invention, there is provided a display drive method for driving a signal electrode based on grayscale data of (a+b) bits (a and b are positive integers), the display drive method comprising:

setting an output electrode electrically connected to the signal electrode at a precharge voltage in a first period within a drive period;

setting the output electrode which has been set at the precharge voltage at a reference voltage based on the grayscale data; and adjusting a voltage of the output electrode by using the grayscale data, the output electrode having been set at the reference voltage.

In this configuration, the voltage to be supplied to the signal electrode during the drive period is set at the precharge voltage, then roughly set at the reference voltage based on the grayscale data, and adjusted based on the grayscale data. Therefore, a target grayscale voltage can be applied to the signal electrode without using an operational amplifier. This enables to reduce the consumption of a current constantly flowing through the operational amplifier, leading to the reduction of power consumption of the display driver circuit.

In this display drive method, the output electrode may be set at the reference voltage based on high order "a" bit(s) in the grayscale data of (a+b) bits.

This enables to use the high order "a" bit(s) to roughly divide grayscale levels determined based on the grayscale data of (a+b) bits. For example, high order four bits in grayscale data can be used to divide grayscale levels determined based on grayscale data of six bits into 16 levels.

Since a target grayscale voltage can be applied to the signal electrode without using an operational amplifier, as described, the number of types of reference voltages provided in advance can be reduced, enabling to simplify the configuration.

In this display drive method, a first power supply voltage and a second power supply voltage may be respectively supplied to a first power supply line and a second power supply line; and one of the first and second power supply lines may be electrically connected to the output electrode which has been set at the reference voltage during a period of a pulse width determined based on low order "b" bit(s) or the low order "b" bit(s) and at least part of high order "a" bit(s) in the grayscale data of (a+b) bits.

Since the PWM control electrically connects the first and second power supply lines to the output electrode, a target grayscale voltage can be set with high accuracy according to the load to the capacitive output electrode and grayscale characteristics of the display panel.

In this display drive method, the output electrode which has been set at the reference voltage may be set at a gamma-corrected voltage based on the grayscale data of (a+b) bits.

Since the output electrode which has been set at the reference voltage is set at the gamma-corrected voltage based on the grayscale data, a period in which the gamma-corrected voltage is driven can be shortened, leading to the simplification of the configuration.

Further embodiments of the present invention are described below in detail with reference to the drawings.

1. Liquid Crystal Device

FIG. 1 shows an outline of a configuration of a liquid crystal device.

A liquid crystal device (electro-optical device or display device in abroad sense) 10 is a TFT liquid crystal device. The liquid crystal device 10 includes a liquid crystal panel (display panel in a broad sense) 20.

The liquid crystal panel 20 is formed on a glass substrate, for example. A plurality of scanning electrodes (gate lines) $G_1$ to $G_N$ (N is a natural number equal to or larger than two) which are arranged in the Y direction and extend in the X direction, and a plurality of signal electrodes (source lines) $S_1$ to $S_M$ (M is a natural number equal to or larger than two) which are arranged in the X direction and extend in the Y direction are disposed on the glass substrate. A pixel (pixel region) is disposed corresponding to the intersecting point of the scanning electrode $G_n$ ($1 \leqq n \leqq N$, n is a natural number) and the signal electrode $S_m$ ($1 \leqq m \leqq M$, m is a natural number). The pixel includes a TFT (pixel switch element in a broad sense) $\mathbf{22}_{nm}$.

A gate electrode of the TFT $\mathbf{22}_{nm}$ is connected to the scanning electrode $G_n$. A source electrode of the TFT $\mathbf{22}_{nm}$ is connected to the signal electrode $S_m$. A drain electrode of the TFT $\mathbf{22}_{nm}$ is connected to a pixel electrode $\mathbf{26}_{nm}$ of a liquid crystal capacitance (liquid crystal element in a broad sense) $\mathbf{24}_{nm}$.

The liquid crystal capacitance $\mathbf{24}_{nm}$ is formed by sealing a liquid crystal between the pixel electrode $\mathbf{26}_{nm}$ and a common electrode $\mathbf{28}_{nm}$ opposite to the pixel electrode $\mathbf{26}_{nm}$. The transmittance of the pixel is changed corresponding to the voltage applied between these electrodes. A common electrode voltage Vcom is supplied to the common electrode $\mathbf{28}_{nm}$.

The liquid crystal device 10 may include a signal driver IC 30. A display driver circuit in the present embodiment may be used as the signal driver IC 30. The signal driver IC 30 drives the signal electrodes $S_1$ to $S_M$ of the liquid crystal panel 20 based on image data.

The liquid crystal device 10 may include a scanning driver IC (scanning electrode driver circuit in abroad sense) 32. The scanning driver IC 32 sequentially drives the scanning electrodes $G_1$ to $G_N$ of the liquid crystal panel 20 within one vertical scanning period.

The liquid crystal device 10 may include a power supply circuit 34. The power supply circuit 34 generates voltage necessary for driving the signal electrode and supplies the voltage to the signal driver IC 30. The power supply circuit 34 generates voltage necessary for driving the scanning electrode and supplies the voltage to the scanning driver IC 32.

The liquid crystal device 10 may include a common electrode driver circuit 36. The common electrode voltage Vcom generated by the power supply circuit 34 is supplied to the common electrode driver circuit 36. The common electrode driver circuit 36 outputs the common electrode voltage Vcom to the common electrode of the liquid crystal panel 20.

The liquid crystal device 10 may include a signal control circuit 38. The signal control circuit 38 controls the signal driver IC 30, the scanning driver IC 32, and the power supply circuit 34 according to the contents set by a host such as a central processing unit (hereinafter abbreviated as "CPU") (not shown). For example, the signal control circuit 38 supplies setting of the operation mode and a vertical synchronization signal or a horizontal synchronization signal generated therein to the signal driver IC 30 and the scanning driver IC 32. The signal control circuit 38 controls polarity inversion timing of the power supply circuit 34.

In FIG. 1, the liquid crystal device 10 includes the power supply circuit 34, the common electrode driver circuit 36, and the signal control circuit 38. However, at least one of these circuits may be provided outside the liquid crystal device 10. The liquid crystal device 10 may include the host.

Figure 2:
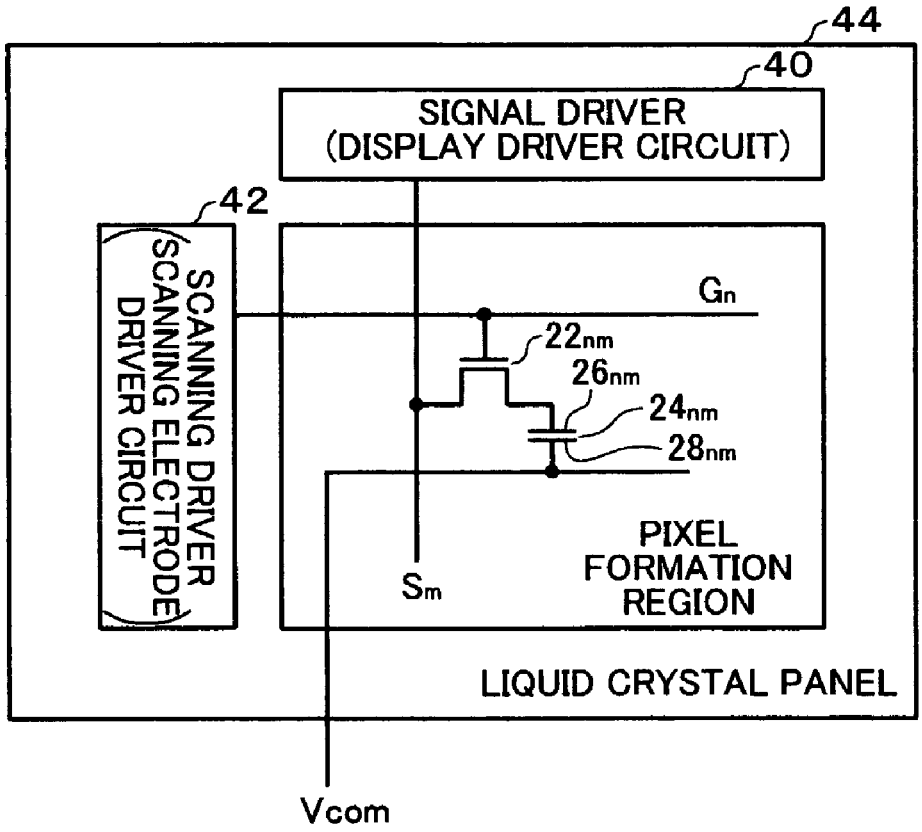
FIG. 2 is a diagram showing a configuration example of a liquid crystal panel.

As shown in FIG. 2, a signal driver (display driver circuit in a broad sense) 40 having a function of the signal driver IC 30 and a scanning driver (scanning electrode driver circuit in a broad sense) 42 having a function of the scanning driver IC 32 may be formed on the glass substrate on which a liquid crystal panel 44 is formed, and the liquid crystal panel 44 may be included in the liquid crystal device 10. Only the signal driver 40 may be formed on the glass substrate on which the liquid crystal panel 44 is formed.

2. Signal Driver IC

Figure 3:
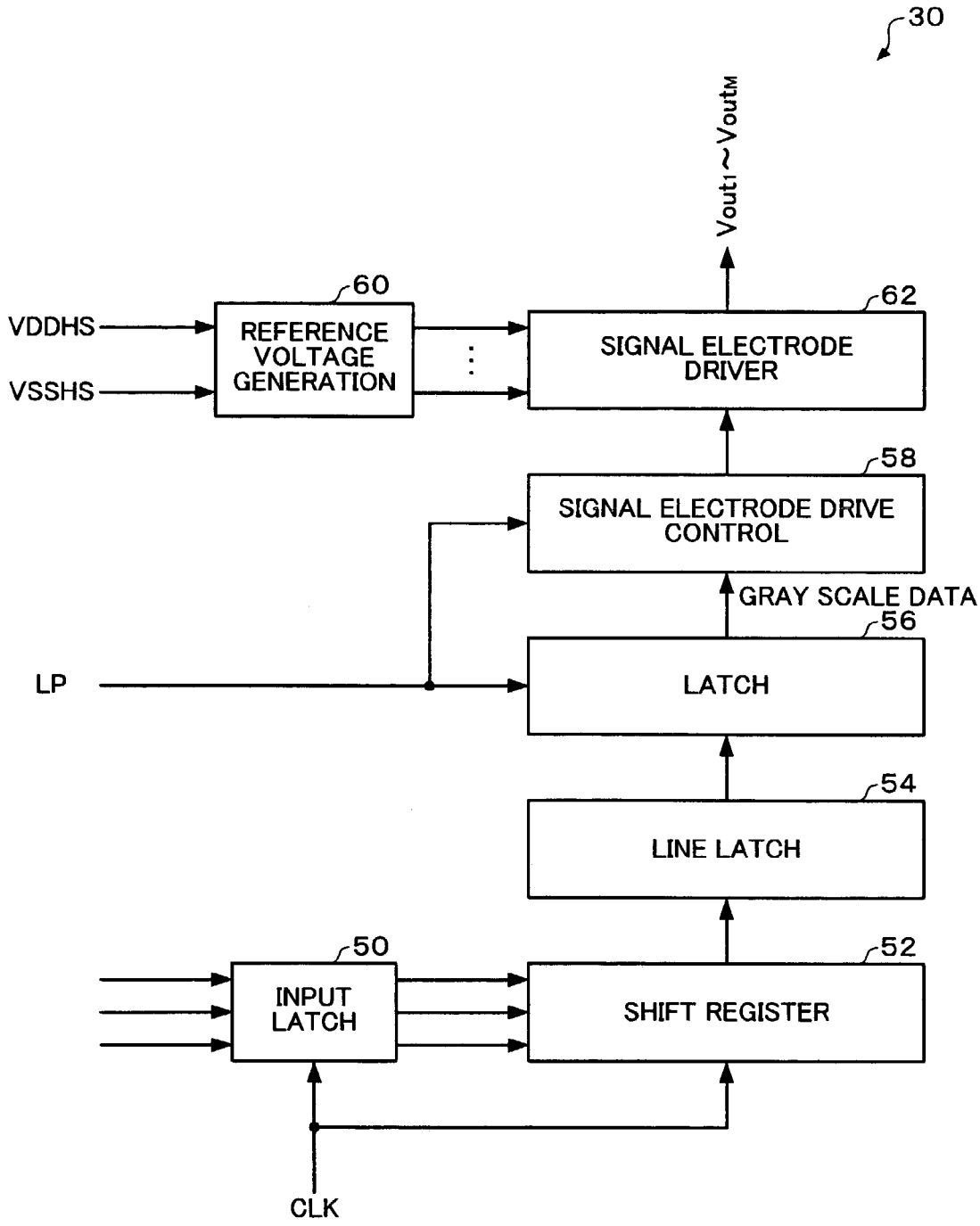
FIG. 3 is a block diagram schematically showing configuration of a signal driver IC.

FIG. 3 shows an outline of a configuration of the signal driver IC 30.

The signal driver IC 30 may include an input latch circuit 50, a shift register 52, a line latch circuit 54, and a latch circuit 56.

The input latch circuit 50 latches grayscale data consisting of each six bits of RGB signals supplied from the signal control circuit 38 shown in FIG. 1 based on a clock signal CLK, for example. The clock signal CLK is supplied from the signal control circuit 38.

The grayscale data latched by the input latch circuit 50 is sequentially shifted by the shift register 52 based on the clock signal CLK. The grayscale data sequentially shifted by the shift register 52 is captured in the line latch circuit 54.

The grayscale data captured in the line latch circuit 54 is latched by the latch circuit 56 at timing of a latch pulse signal LP. The latch pulse signal LP is input at the timing of a horizontal scanning cycle.

The signal driver IC 30 drives the signal electrode based on grayscale data of (a+b) bits (a and b are positive integers) without using an operational amplifier. In more detail, the signal driver IC 30 divides drive timing into three stages and drives the signal electrode by using the grayscale data of (a+b) bits. Therefore, the signal driver IC 30 may include a signal electrode drive control circuit 58, a reference voltage generation circuit 60, and a signal electrode driver circuit 62.

The signal electrode drive control circuit 58 generates drive control signals corresponding to the three stages in a horizontal scanning period (select period or drive period in a broad sense) by using the grayscale data latched by the latch circuit 56, and supplies the drive control signals to the signal electrode driver circuit 62.

The reference voltage generation circuit 60 generates a plurality of types of reference voltages based on the high order "a" bit(s) in the grayscale data of (a+b) bits.

If the grayscale data include six bits (a=4 and b=2), the reference voltages having the number of types corresponding to 64 grayscale levels are necessary between a system power supply voltage VDDHS on the high potential side and a system ground power supply voltage VSSHS on the low potential side. The reference voltage generation circuit 60 generates 16 types of reference voltages V4, V8, . . . , and V64 (=VDDHS) for the high order four bits in the grayscale data. The reference voltages V4, V8, . . . , and V64 are supplied to the signal electrode driver circuit 62.

The signal electrode driver circuit 62 drives output electrodes $Vout_1$ to $Vout_M$ by using the reference voltages supplied from the reference voltage generation circuit 60 and the drive control signal supplied from the signal electrode drive control circuit 58. The output electrodes $Vout_1$ to $Vout_M$ are electrically connected to the signal electrodes $S_1$ to $S_M$, respectively.

Figure 4:
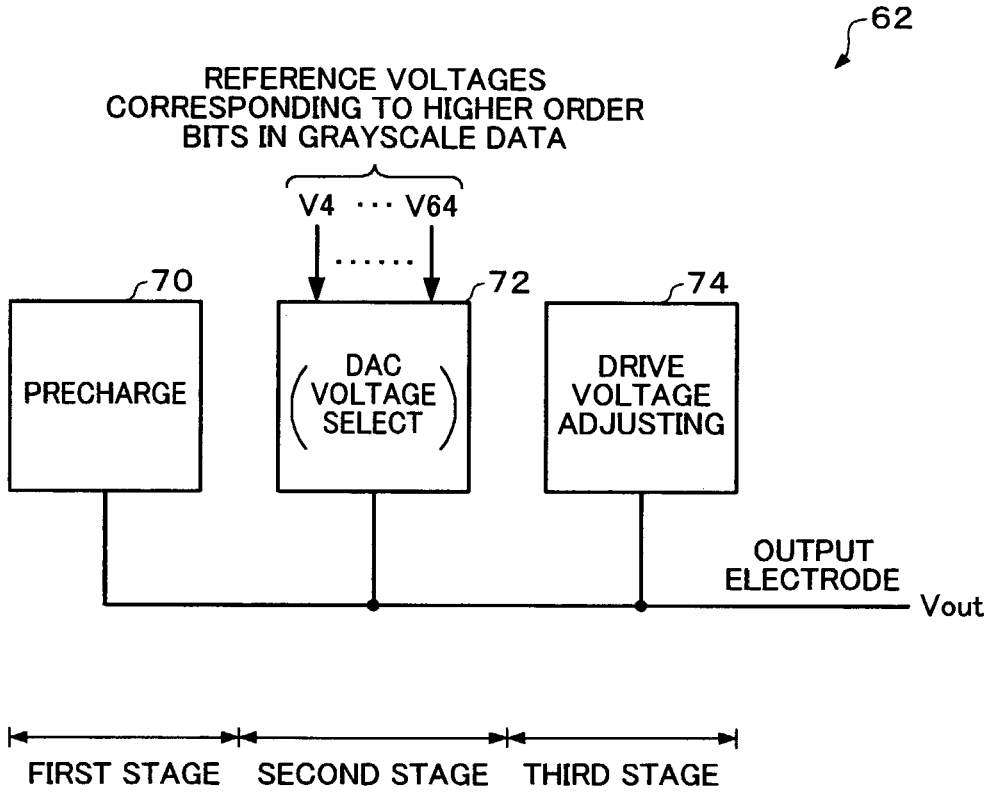
FIG. 4 is a block diagram schematically showing configuration of a signal electrode driver circuit.

FIG. 4 shows an outline of the principle of a configuration of the signal electrode driver circuit 62.

FIG. 4 shows the configuration for one output electrode among the output electrodes $Vout_1$ to $Vout_M$. The following description is given on the assumption that a and b in the grayscale data of (a+b) bits are respectively "4" and "2".

The signal electrode driver circuit 62 includes a precharge circuit 70, a DAC circuit (voltage select circuit in a broad sense) 72, and a drive voltage adjusting circuit 74.

The precharge circuit 70 precharges the output electrode Vout at a given precharge voltage in a first stage which is the first period of one horizontal scanning period (1H) (select period or drive period in a broad sense). In the case where polarity inversion drive in which the polarity of the voltage applied to the liquid crystal capacitance is reversed in a unit of frame, line, or dot is performed by the signal driver IC 30, a voltage VCOM in phase with the common electrode voltage Vcom which is the center voltage of the polarity inversion drive may be employed as the precharge voltage. In the case where the common electrode voltage Vcom is changed in the range of −0.5 V to 4.5 V in a polarity inversion cycle, the voltage VCOM may be changed in the range of 0 V to 5 V (VSSHS to VDDHS) in phase with the common electrode voltage Vcom.

The DAC circuit 72 selects one of reference voltages supplied from the reference voltage generation circuit 60 based on a select signal included in the drive control signal supplied from the signal electrode drive control circuit 58, and sets the output electrode Vout at the selected reference voltage in a second stage subsequent to the first stage. The select signal is generated in the signal electrode drive control circuit 58 based on high order bit(s) (high order four bits, for example) in the grayscale data of six bits.

The drive voltage adjusting circuit 74 adjusts the voltage of the output electrode Vout based on a control signal (gate signal) included in the drive control signal supplied from the signal electrode drive control circuit 58 in a third stage subsequent to the second stage. The control signal is generated in the signal electrode drive control circuit 58 based on low order bit(s) or the low order bit(s) and at least a part of high order bit(s) in the grayscale data of six bits (for example, low order two bits in the grayscale data of six bits, or the grayscale data of six bits).

According to this configuration, in the case where the voltage applied to the output electrode is changed in the polarity inversion drive, the output electrode set at the precharge voltage in the first stage can be roughly set at a target voltage corresponding to high order four bits in the grayscale data in the second stage, and then adjusted to a grayscale voltage corresponding to the grayscale data of six bits in the third stage. Therefore, the target grayscale voltage can be applied to the signal electrode without using an operational amplifier, leading to the reduction in the consumption of a current constantly flowing through an operational amplifier and the reduction in power consumption.

A specific configuration of the signal electrode driver circuit 62 is described below.

2.1 First Embodiment

In a first embodiment, a pulse width modulation (hereinafter abbreviated as "PWM") circuit which adjusts a voltage of the output electrode by PWM control based on low order two bits or low order two bits and at least part of high order four bits in the grayscale data of six bits is used as the drive voltage adjusting circuit 74.

Figure 5:
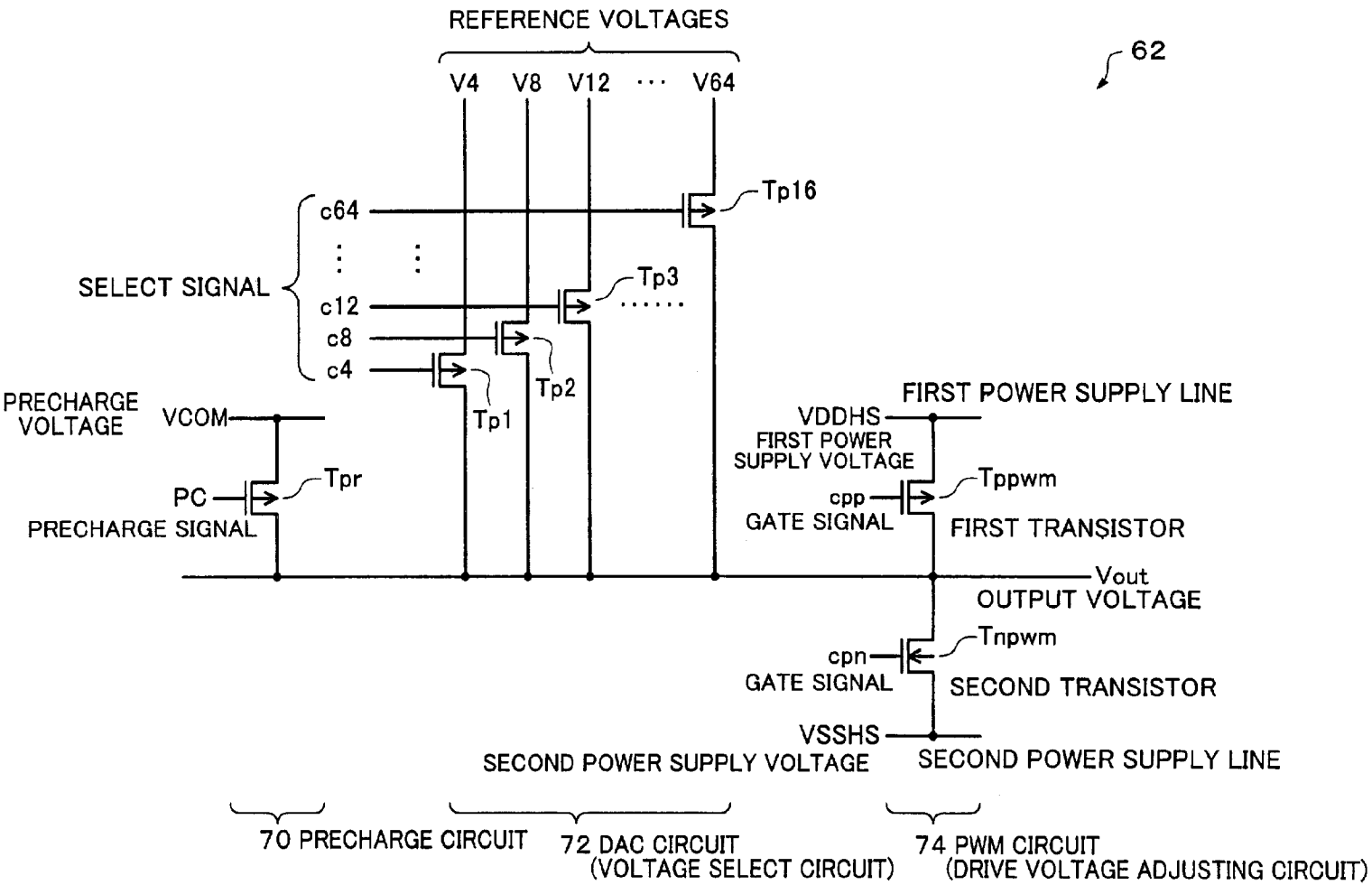
FIG. 5 is a circuit diagram showing a configuration example of a signal electrode driver circuit in a first embodiment.

FIG. 5 shows a configuration example of the signal electrode driver circuit 62 in the first embodiment.

The precharge circuit 70 includes a p-type MOS transistor Tpr for precharging. A source terminal of the p-type MOS transistor Tpr is connected to a precharge line to which the voltage VCOM (precharge voltage in a broad sense) is supplied. A drain terminal of the p-type MOS transistor Tpr is connected to the output electrode Vout. A precharge signal PC is applied to a gate electrode of the p-type MOS transistor Tpr. The precharge signal PC is generated in the signal electrode drive control circuit 58 so that the precharge signal PC is activated only in a given first period (period in the first stage) of one horizontal scanning period (1H) specified by the latch pulse signal LP, for example.

In the case where the polarity of the voltage applied to the output electrode is reversed from negative to positive by polarity inversion drive, the voltage VCOM may be shifted to the positive side so as to be closer to the target grayscale voltage and used as the precharge voltage. In this case, the output electrode can be allowed to reach the target grayscale voltage as soon as possible. In the case where the polarity is reversed from positive to negative by polarity inversion drive, the voltage VCOM may be shifted to the negative side so as to be closer to the target grayscale voltage and used as the precharge voltage. In this case, the output electrode can also be allowed to reach the target grayscale voltage as soon as possible.

The DAC circuit (voltage select circuit in a broad sense) 72 includes p-type MOS transistors Tp1 to Tp16 for selecting voltage. A source terminal of the p-type MOS transistor Tpj ($1 \leqq j \leqq 16$) is connected to a reference voltage supply line to which the reference voltage V(4j) (=V4, V8, . . . , and V64) supplied from the reference voltage generation circuit 60 is applied. A drain terminal of the p-type MOS transistor Tpj is connected to the output electrode Vout. A select signal cj is applied to a gate electrode of the p-type MOS transistor Tpj. The select signal c(4*j*) (=c4, c8, . . . , and c64) is generated in the signal electrode drive control circuit 58, for example.

The drive voltage adjusting circuit 74 includes first and second transistors Tppwm and Tnpwm. The first transistor Tppwm may be realized by using a p-type MOS transistor. The second transistor Tnpwm may be formed by using an n-type MOS transistor.

A source terminal of the first transistor Tppwm is connected to a first power supply line to which the system power supply voltage VDDHS (first power supply voltage in a broad sense) on the high potential side is supplied. A drain terminal of the first transistor Tppwm is connected to the output electrode Vout. A gate signal cpp is applied to a gate electrode of the first transistor Tppwm. The gate signal cpp is generated in the signal electrode drive control circuit 58, for example.

A source terminal of the second transistor Tnpwm is connected to a second power supply line to which the system ground power supply voltage VSSHS (second power supply voltage in abroad sense) on the low potential side is supplied. A drain terminal of the second transistor Tnpwm is connected to the output electrode Vout. A gate signal cpn is applied to a gate electrode of the second transistor Tnpwm. The gate signal cpn is generated in the signal electrode drive control circuit 58, for example.

As described above, the drive voltage adjusting circuit 74 electrically connects the output electrode with the system power supply voltage VDDHS on the high potential side through the first transistor Tppwm, or electrically connects the output electrode with the system ground power supply voltage VSSHS on the low potential side through the second transistor Tnpwm. This enables the voltage of the output electrode to be adjusted by increasing or decreasing the voltage of the capacitive output electrode corresponding to a conducting period of the first transistor Tppwm or the second transistor Tnpwm. The conducting periods of the first and second transistors Tppwm and Tnpwm are controlled by the pulse widths of the gate signals cpp and cpn.

Figure 6:
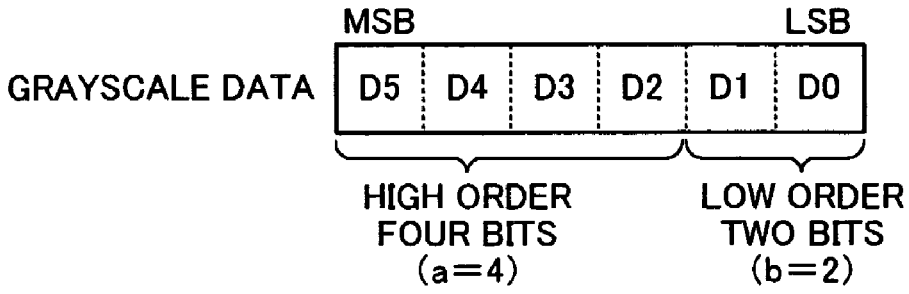
FIG. 6 is a diagram illustrative of grayscale data.

As shown in FIG. 6, there is provided grayscale data of six bits D5 to D0, for example. The grayscale data include high order four (a=4) bits D5 to D2 and low order two (b=2) bits D1 and D0.

Figure 7:
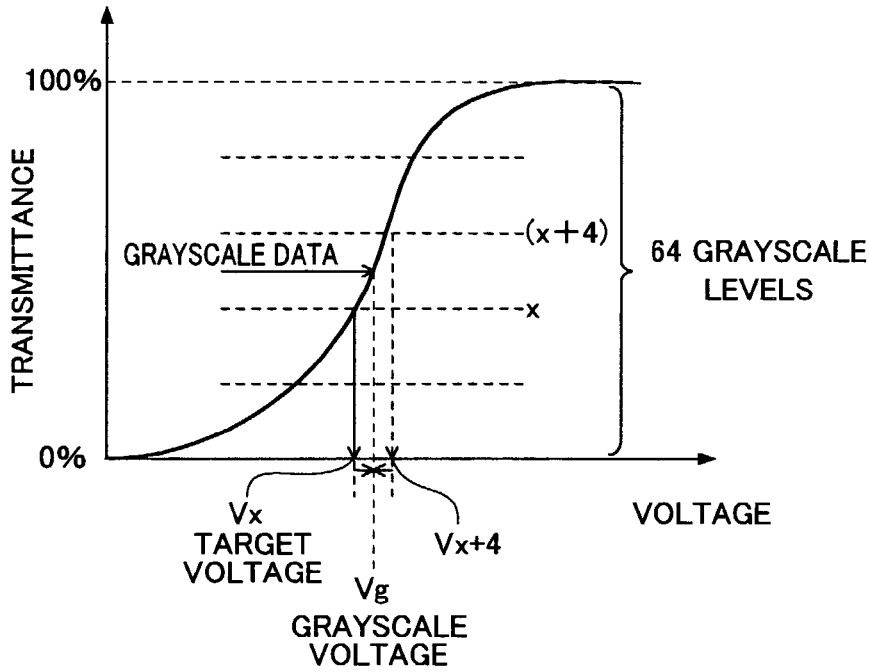
FIG. 7 is a diagram illustrative of grayscale characteristics.

Grayscale characteristics of the liquid crystal panel 20 are as shown in FIG. 7, for example. Specifically, the rate of change in transmittance with respect to the change in voltage applied to the signal electrode is small in regions in which the transmittance of the pixel is high or low. However, the rate of change in transmittance with respect to the change in voltage applied to the signal electrode is increased in a region in which the transmittance of the pixel is medium. Therefore, the grayscale voltage Vg applied to the signal electrode based on the grayscale data must be set at a voltage determined taking the grayscale characteristics into consideration.

Therefore, there is provided 16 types of reference voltages for high order four bits in the grayscale data, when the grayscale having the transmittances of pixels between 0% and 100% is divided into 64 grayscale levels.

In the case of setting the output electrode Vout at the grayscale voltage Vg based on the grayscale data, the output electrode Vout is precharged to the precharge voltage when the grayscale data of six bits is input in the first stage. In the second stage, the target voltage of the grayscale data of six bits between the grayscale level x ($0 \leqq x \leqq 60$, x is an integer) and the grayscale level (x+4) provided in advance is set as a voltage Vx (or voltage (Vx+4)), and a select signal cx (or (cx+4)) for selecting the target voltage Vx (or a target voltage (Vx+4)) is generated. In the third stage, in order to adjust the output electrode Vout to the grayscale voltage Vg, the gate signal cpp having a pulse width necessary for increasing the voltage of the output electrode Vout set at the target voltage Vx to the grayscale voltage Vg (or gate signal cpn having a pulse width necessary for decreasing the voltage of the output electrode Vout set at the target voltage (Vx+4) to the grayscale voltage Vg) is generated. The pulse widths of the gate signals cpp and cpn are set taking the load of the display panel to be driven into consideration.

Figures 8A, 8B:
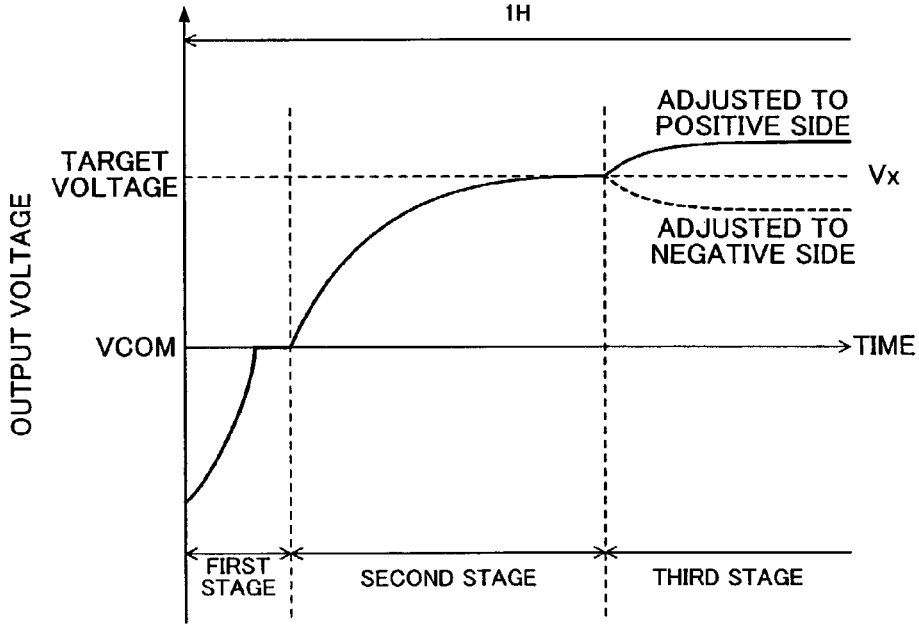
FIG. 8A is a diagram illustrative of the relationship among grayscale data, a target voltage in a second stage and a gate signal in a third stage according to the first embodiment.
FIG. 8B is a graph showing change in voltage of an output electrode.

As shown in FIG. 8A, the target voltage in the second stage and the adjustment direction (increased or decreased) and the pulse width (in more detail, the number of pulses corresponding to the pulse width) in the third stage may be decoded and output by the signal electrode drive control circuit 58 corresponding to the grayscale data of six bits, for example. This enables the select signal cx for selecting the target voltage Vx in the second stage to be generated in the signal electrode drive control circuit 58 when the grayscale data of six bits D5 to D0 is input. Moreover, the gate signal having a pulse width corresponding to the number of pulses based on the grayscale data can be generated as the gate signal cpp (or gate signal cpn) having a pulse width for adjustment of the voltage in the signal electrode drive control circuit 58 in the third stage when the grayscale data of six bits D5 to D0 is input.

As a result, as shown in FIG. 8B, the output electrode is set at the voltage VCOM by the precharge circuit 70 in the first stage of the horizontal scanning period, and set at the target voltage Vx by the DAC circuit 72 in the second stage. In the third stage, the output electrode is connected to the first or second power supply line for only a period corresponding to the pulse width of the gate signal cpp or the gate signal cpn by the drive voltage adjusting circuit (PWM circuit) 74, whereby the output voltage is adjusted.

Figure 9:
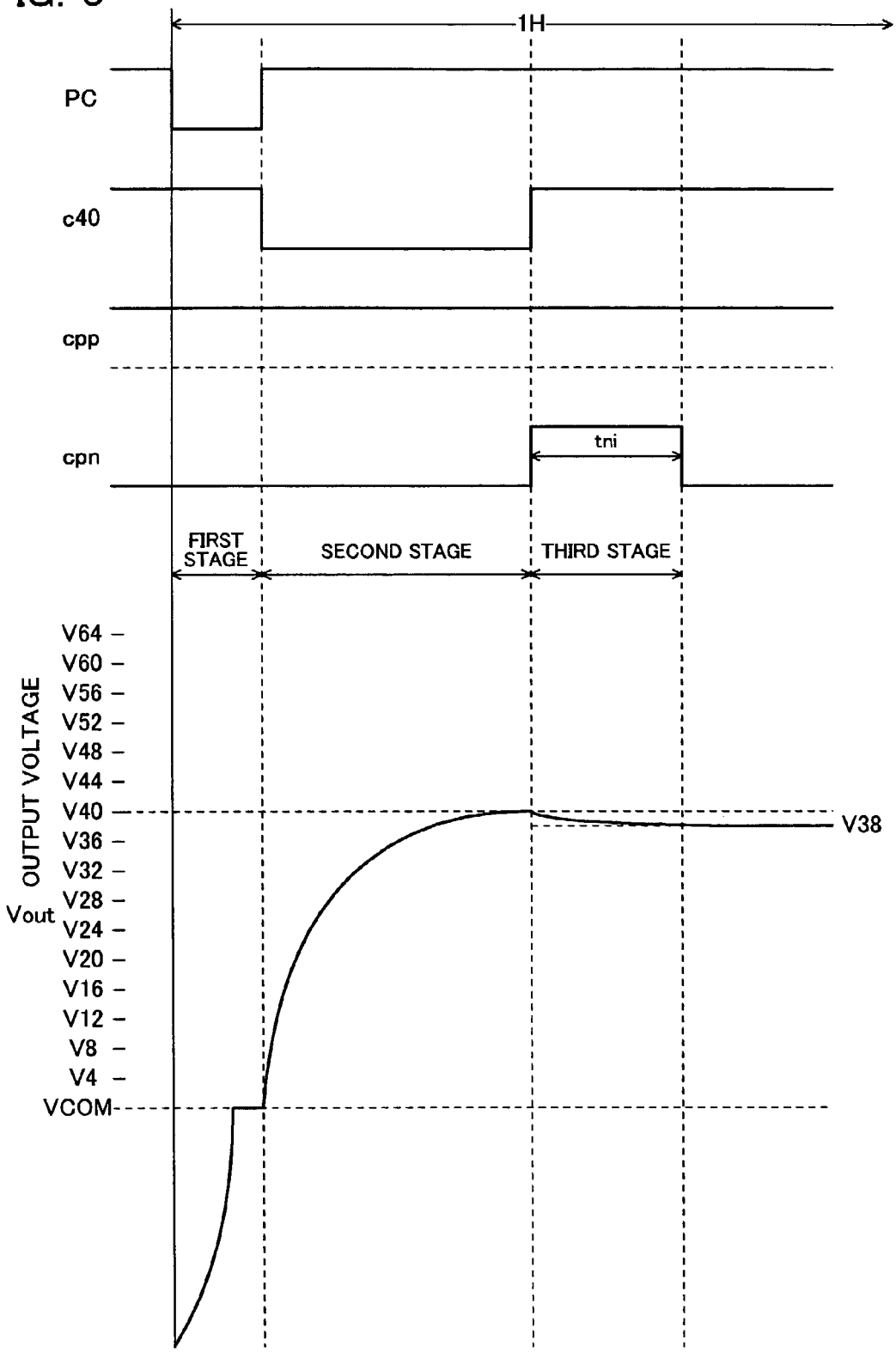
FIG. 9 is a timing chart showing an example of change in output voltage in the first embodiment.

FIG. 9 shows an example of the operation timing of the signal electrode driver circuit 62 in the first embodiment.

In this example, a case where the grayscale data of six bits D5 to D0 is "100110", and the grayscale voltage V38 is output by reversing the output voltage from negative to positive by polarity inversion drive is described.

The signal electrode drive control circuit 58 activates the precharge signal PC only in the first period of one horizontal scanning period specified by the latch pulse signal LP. This allows the voltage of the output electrode Vout to be set at the voltage VCOM supplied to the precharge line in the precharge circuit 70 (first stage).

The signal electrode drive control circuit 58 to which the grayscale data is input from the latch circuit 56 activates the select signal c40 which indicates the target voltage is V40 based on the grayscale data. This allows only the p-type MOS transistor Tp40 to conduct in the DAC circuit 72, whereby the reference voltage signal line to which the reference voltage V40 among a plurality of the reference voltages supplied from the reference voltage generation circuit 60 is supplied is electrically connected to the output electrode Vout. The voltage of the output electrode Vout is set at the reference voltage V40 (second stage).

As shown in FIG. 8A, the signal electrode drive control circuit 58 to which the grayscale data is input from the latch circuit 56 generates the gate signal cpn having a pulse width tni determined taking the load of the signal electrode of the liquid crystal panel 20 into consideration based on the grayscale data. This allows the second transistor Tnpwm to conduct in the drive voltage adjusting circuit (PWM circuit) 74, whereby the second power supply line is electrically connected to the output electrode Vout only in a period equal to the pulse width tni. The voltage of the output electrode Vout is adjusted to the grayscale voltage V38.

As described above, according to the first embodiment, since the output electrode connected to the signal electrode of the liquid crystal panel 20 is driven without using an operational amplifier, consumption ot a current constantly flowing through an operational amplifier is decreased, whereby a decrease in power consumption can be achieved. Moreover, since the PWM circuit is used as the drive voltage adjusting circuit, the voltage of the output electrode can be adjusted with high accuracy to an optimum grayscale voltage which should be output corresponding to the grayscale characteristics of the display panel.

The select signals c4 to c64 of the DAC circuit 72 may be decoded and output based on only high order four bits in grayscale data. Moreover, the gate signals cpp and cpn may be output as signals having a pulse width corresponding to only low order two bits in grayscale data.

2.2 Second Embodiment

In a second embodiment, a gamma (γ) correction circuit is used as the drive voltage adjusting circuit. This gamma correction circuit is capable of correcting the voltage of the output electrode Vout to voltage to which the voltage of the output electrode Vout should be corrected based on the grayscale data of six bits.

Figure 10:
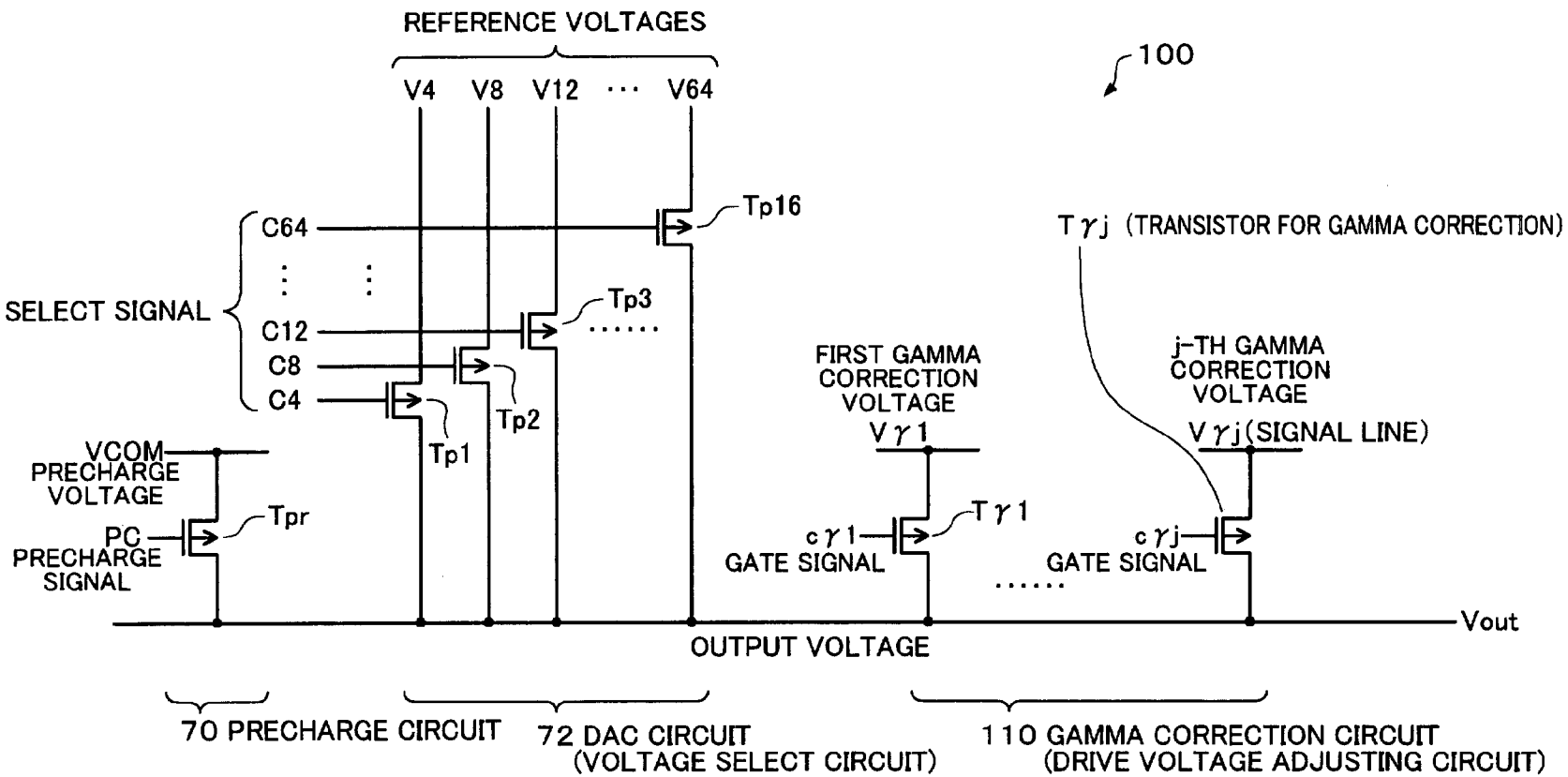
FIG. 10 is a circuit diagram showing a configuration example of a signal electrode driver circuit in a second embodiment.

FIG. 10 shows a configuration example of a signal electrode driver circuit in the second embodiment.

In FIG. 10, sections the same as those of the signal electrode driver circuit 62 in the first embodiment are indicated by the same symbols. Description of these sections is appropriately omitted.

A signal electrode driver circuit 100 in the second embodiment includes the precharge circuit 70 and the DAC circuit 72 in the same manner as the signal electrode driver circuit 62 in the first embodiment. The signal electrode driver circuit 100 includes a drive voltage adjusting circuit 110. A gamma correction circuit is used as the drive voltage adjusting circuit 110. The signal electrode driver circuit 100 may be employed as the signal electrode driver circuit of the signal driver IC shown in FIG. 3.

In the gamma correction circuit 110, at least one transistor for gamma correction is connected between a signal line to which a gamma-corrected voltage is supplied and the output electrode Vout. The voltage of the output electrode is adjusted to the gamma-corrected voltage by a gate signal applied to a gate electrode of the transistor for gamma correction.

In the case where the gamma correction circuit 110 includes only a first transistor Tγ1 for gamma correction which is a p-type MOS transistor, a source terminal of the first transistor Tγ1 is connected to a signal line to which a first gamma-corrected voltage Vγ1 is supplied, and a drain terminal of the first transistor Tγ1 is connected to the output electrode Vout. A gate signal cγ1 is applied to a gate electrode of the first transistor Tγ1. The gate signal cγ1 is generated in the signal electrode drive control circuit 58. In this case, the voltage of the output electrode is gamma-corrected to one of a plurality of gamma-corrected voltages by selectively supplying the gamma-corrected voltage to the signal line.

In the case where the gamma correction circuit 110 includes first to j-th (j is an integer equal to or larger than two) transistors Tγ1 to Tγj for gamma correction which are p-type MOS transistors, the source terminals of the first to j-th transistors Tγ1 to Tγj are respectively connected to the signal lines to which the first to j-th gamma-corrected voltages Vγ1 to Vγj are supplied, and the drain terminals of the first to j-th transistors Tγ1 to Tγj are connected to the output electrode Vout. The gate signals cγ1 to cγj are respectively applied to the gate electrodes of the first to j-th transistors Tγ1 to Tγj. The gate signals cγ1 to cγj are generated in the signal electrode drive control circuit 58.

In the drive voltage adjusting circuit 110, the signal line to which the gamma-corrected voltage is supplied is electrically connected to the output electrode through the transistor for gamma correction. This enables the grayscale display of the liquid crystal panel 20 to be realized by using an extremely simple configuration by digital control using the gate signal.

In this case, the signal electrode drive control circuit 58 may decode and output the target voltage in the second stage and the gamma-corrected voltage in the third stage corresponding to the grayscale data of six bits, as shown in FIG. 11. This enables the select signal cx for selecting the target voltage Vx in the second stage and the gate signal cγx of the transistor for gamma correction for gamma correcting the voltage of the output electrode to the gamma-corrected voltage Vγx in the third stage to be generated in the signal electrode drive control circuit 58 when the grayscale data of six bits D5 to D0 is input.

Figure 12:
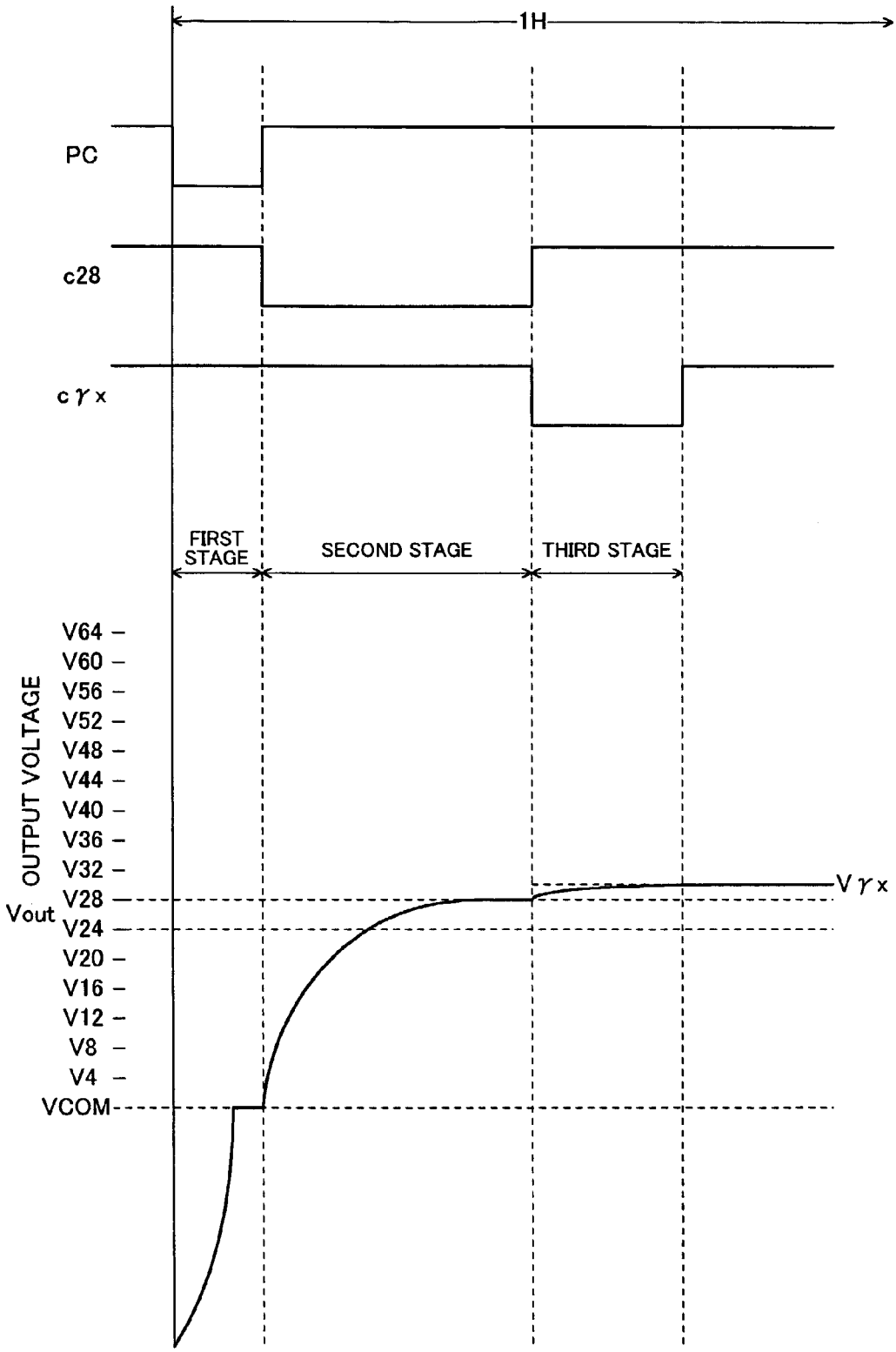
FIG. 12 is a timing chart showing an example of change in output voltage in the second embodiment.

FIG. 12 shows an example of the operation timing of the signal electrode driver circuit 100 in the second embodiment.

In this example, a case where the grayscale data of six bits D5 to D0 is "011100", and the grayscale voltage Vγx is output by reversing the output voltage from negative to positive by polarity inversion drive is described.

The signal electrode drive control circuit 58 activates the precharge signal PC only in the first period of one horizontal scanning period specified by the latch pulse signal LP. This allows the voltage of the output electrode Vout to be set at the voltage VCOM supplied to the precharge line in the precharge circuit 70 (first stage).

The signal electrode drive control circuit 58 to which the grayscale data is input from the latch circuit 56 activates the select signal c28 which indicates the target voltage is V28 based on the grayscale data. This allows only the p-type MOS transistor Tp28 to conduct in the DAC circuit 72, whereby the reference voltage signal line to which the reference voltage V28 among a plurality of the reference voltages supplied from the reference voltage generation circuit 60 is supplied is electrically connected to the output electrode Vout. The voltage of the output electrode Vout is set at the reference voltage V28 (second stage).

The signal electrode drive control circuit 58 to which the grayscale data is input from the latch circuit 56 generates the gate signal cγx for correcting the voltage of the output electrode Vout to the gamma-corrected voltage Vγx based on the grayscale data. This allows the transistor for gamma correction to which the gate signal cγx is applied at the gate electrode to conduct in the drive voltage adjusting circuit (gamma correction circuit) 110, whereby the signal line to which the gamma-corrected voltage Vγx is supplied is electrically connected to the output electrode Vout. As a result, the voltage of the output electrode Vout is adjusted to the gamma-corrected voltage Vγx.

According to the second embodiment, since the output electrode connected to the signal electrode of the liquid crystal panel 20 is driven without using an operational amplifier, consumption ot a current constantly flowing through an operational amplifier is decreased, whereby a decrease in power consumption can be achieved. Moreover, since the gamma correction circuit is used as the drive voltage adjusting circuit, grayscale display of the display panel can be realized by using an extremely simple configuration.

2.3 Third Embodiment

In a third embodiment, the PWM circuit in the first embodiment and the gamma correction circuit in the second embodiment are used in combination in the drive voltage adjusting circuit.

Figure 13:
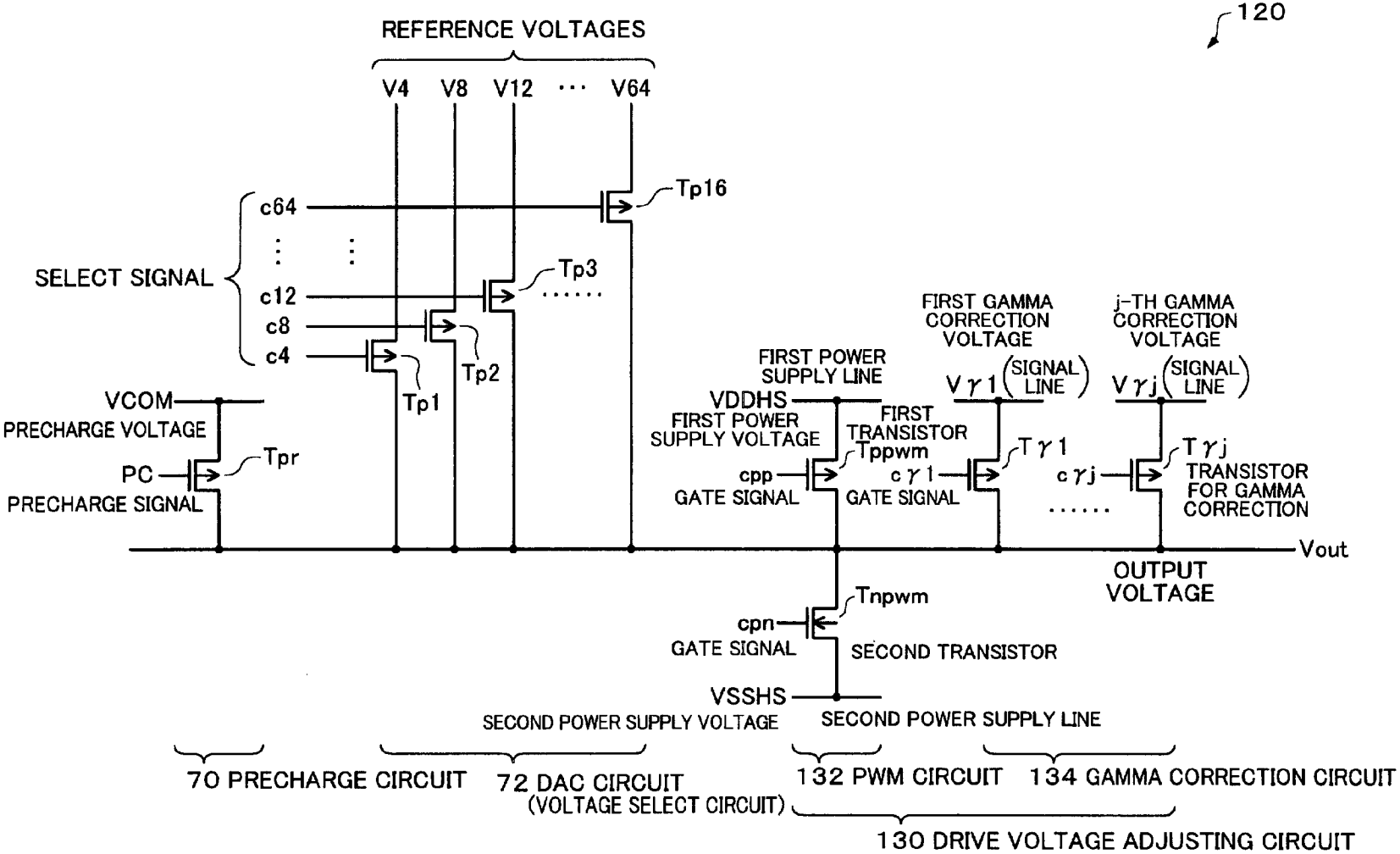
FIG. 13 is a circuit diagram showing a configuration example of a signal electrode driver circuit in a third embodiment.

FIG. 13 shows a configuration example of a signal electrode driver circuit in the third embodiment.

In FIG. 13, sections the same as those of the signal electrode driver circuits 62 and 100 in the first and second embodiments are indicated by the same symbols. Description of these sections is appropriately omitted.

A signal electrode driver circuit 120 in the third embodiment includes the precharge circuit 70 and the DAC circuit 72 in the same manner as the signal electrode driver circuit 62 in the first embodiment. The signal electrode driver circuit 120 includes a drive voltage adjusting circuit 130. The drive voltage adjusting circuit 130 includes a PWM circuit 132 and a gamma correction circuit 134. The signal electrode driver circuit 120 may be employed as the signal electrode driver circuit of the signal driver IC shown in FIG. 3.

Since the PWM circuit 132 and the gamma correction circuit 134 in the drive voltage adjusting circuit 130 in the third embodiment are the same as in the first and second embodiments, detailed description is omitted.

As described above, according to the third embodiment, since the PWM circuit 132 which has a function equivalent to the drive voltage adjusting circuit 74 in the first embodiment and the gamma correction circuit 134 which has a function equivalent to the drive voltage adjusting circuit 110 in the second embodiment are used in the drive voltage adjusting circuit 130, the voltage of the output electrode can be gamma-corrected when adjusting the voltage by the PWM circuit 132 by allowing a bias current to flow by the gamma correction circuit 134.

3. Others

The above embodiments are described taking the liquid crystal device including a liquid crystal panel using TFTs as an example. However, the present invention is not limited thereto. For example, the voltage set at the output electrode Vout may be changed into current by using a given current conversion circuit and supplied to a current driven type element. This enables the present invention to be applied to a signal driver IC which drives an organic EL panel including organic EL elements which are provided corresponding to pixels specified by signal electrodes and scanning electrodes, for example.

Figure 14:
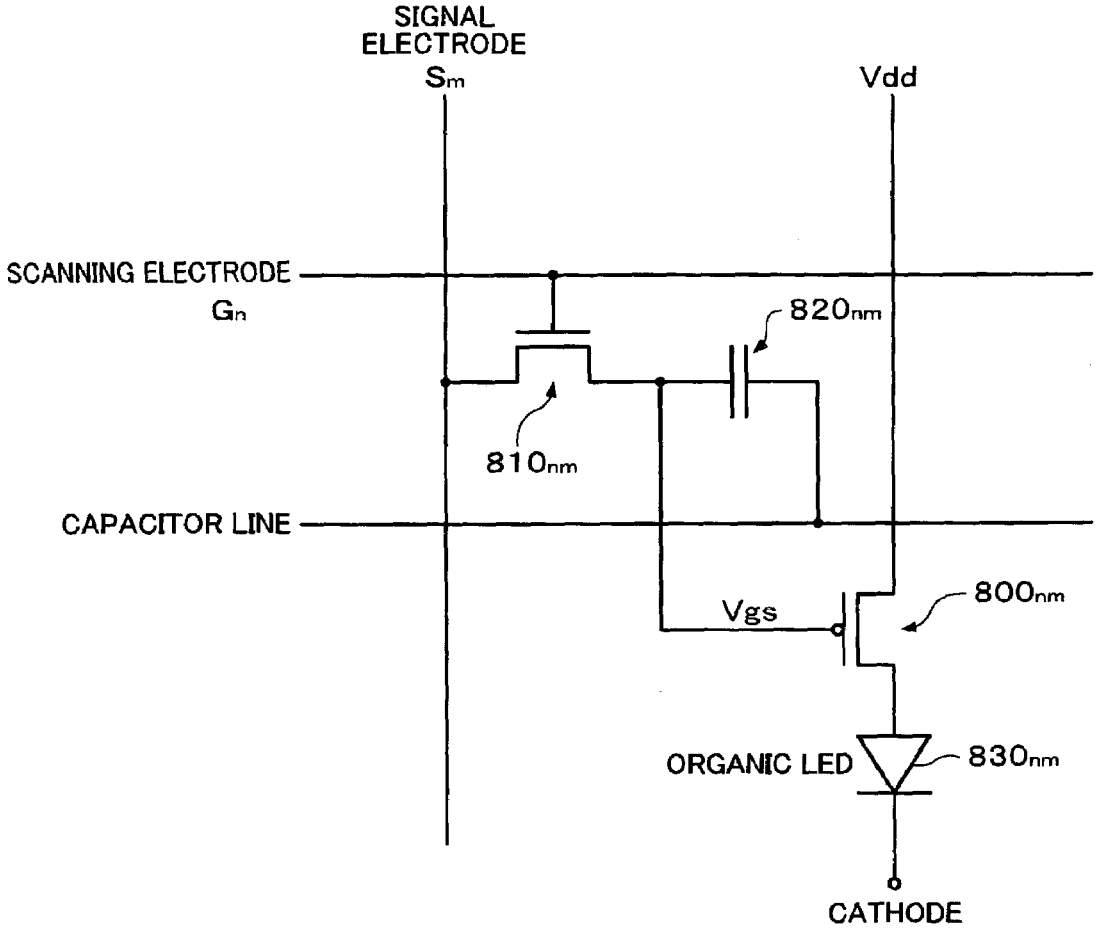
FIG. 14 is a circuit diagram showing an example of a two-transistor pixel circuit in an organic EL panel.

FIG. 14 shows an example of a two-transistor pixel circuit in an organic EL panel driven by the signal driver IC.

The organic EL panel includes a drive TFT $\mathbf{800}_{nm}$, a switch TFT $\mathbf{810}_{nm}$, a storage capacitor $\mathbf{820}_{nm}$, and an organic LED $\mathbf{830}_{nm}$ at an intersecting point of a signal electrode $S_m$ and a scanning electrode $G_n$. The drive TFT $\mathbf{800}_{nm}$ is formed by using a p-type transistor.

The drive TFT $\mathbf{800}_{nm}$ and the organic LED $\mathbf{830}_{nm}$ are connected in series with a power supply line.

The switch TFT $\mathbf{810}_{nm}$ is inserted between a gate electrode of the drive TFT $\mathbf{800}_{nm}$ and the signal electrode $S_m$. A gate electrode of the switch TFT $\mathbf{810}_{nm}$ is connected to the scanning electrode $G_n$.

The storage capacitor $\mathbf{820}_{nm}$ is inserted between the gate electrode of the drive TFT $\mathbf{800}_{nm}$ and a capacitor line.

In this organic EL element, when the scanning electrode $G_n$ is driven and the switch TFT $\mathbf{810}_{nm}$ is turned ON, the voltage of the signal electrode $S_m$ is written into the storage capacitor $\mathbf{820}_{nm}$ and applied to the gate electrode of the drive TFT $\mathbf{800}_{nm}$. A gate voltage Vgs of the drive TFT $\mathbf{800}_{nm}$ is determined depending on the voltage of the signal electrode $S_m$, whereby current flowing through the drive TFT $\mathbf{800}_{nm}$ is determined. Since the drive TFT $\mathbf{800}_{nm}$ is connected in series with the organic LED $\mathbf{830}_{nm}$, current flowing through the drive TFT $\mathbf{800}_{nm}$ flows through the organic LED $\mathbf{830}_{nm}$.

Therefore, if the gate voltage Vgs corresponding to the voltage of the signal electrode $S_m$ is retained by the storage capacitor $\mathbf{820}_{nm}$, in the case where current corresponding to the gate voltage Vgs is caused to flow through the organic LED $\mathbf{830}_{nm}$ in one frame period, a pixel which continues to shine during the frame can be realized.

Figure 15A:
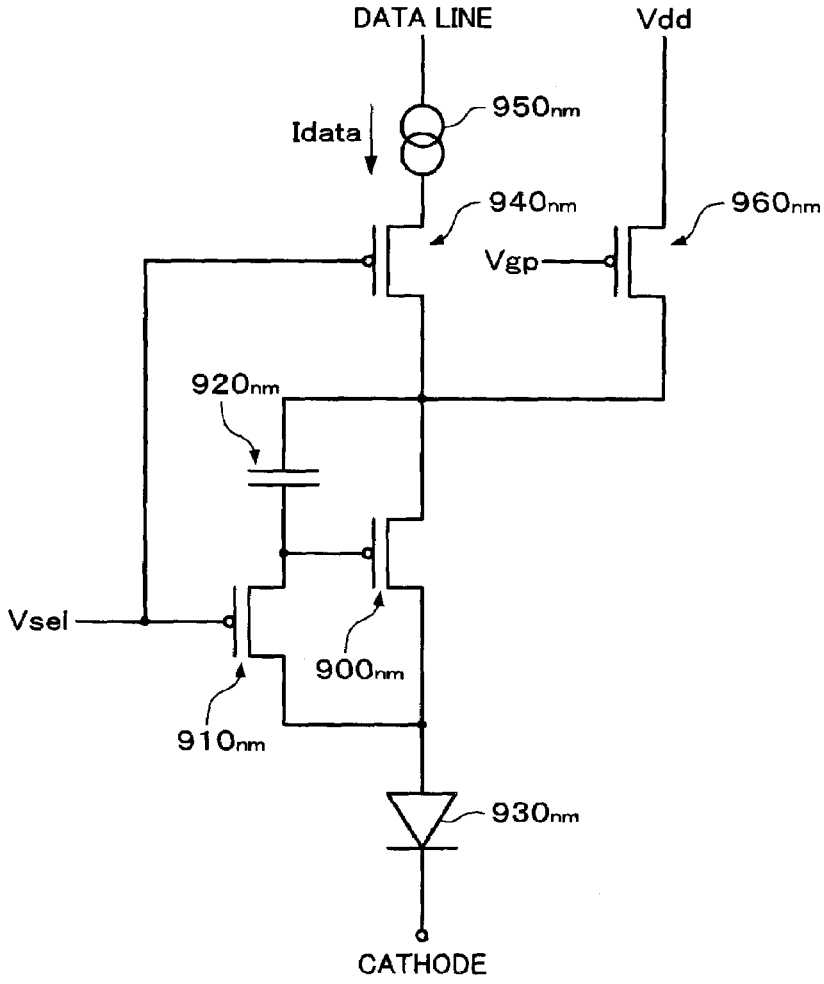
FIG. 15A is a circuit diagram showing an example of a four-transistor pixel circuit in an organic EL panel.
Figure 15B:
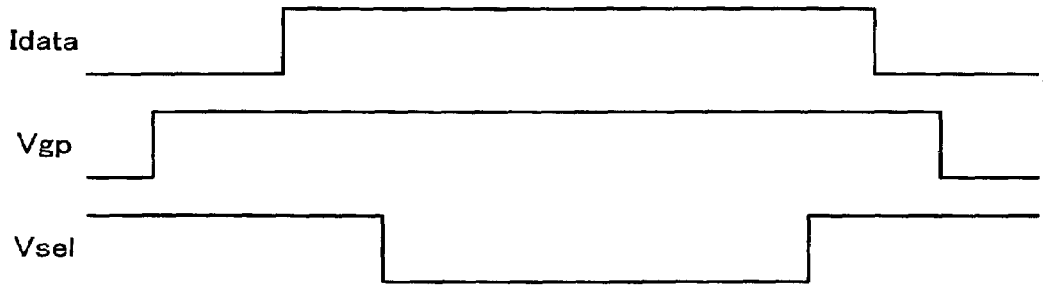
FIG. 15B is a timing chart showing an example of a display control timing of the pixel circuit.

FIG. 15A shows an example of a four-transistor pixel circuit in an organic EL panel driven by using the signal driver IC. FIG. 15B shows an example of the display control timing of the pixel circuit.

The organic EL panel includes a drive TFT $\mathbf{900}_{nm}$, a switch TFT $\mathbf{910}_{nm}$, a storage capacitor $\mathbf{920}_{nm}$, and an organic LED $\mathbf{930}_{nm}$.

The features of the four-transistor pixel circuit differing from the two-transistor pixel circuit shown in FIG. 14 are that a constant current Idata from a constant current source $\mathbf{950}_{nm}$ is supplied to the pixel through a p-type TFT $\mathbf{940}_{nm}$ as a switch element instead of a constant voltage, and that the storage capacitor $\mathbf{920}_{nm}$ and the drive TFT $\mathbf{900}_{nm}$ are connected to the power supply line through a p-type TFT $\mathbf{960}_{nm}$ as a switch element.

In this organic EL element, the power supply line is disconnected by allowing the p-type TFT 960 to be turned OFF by the gate voltage Vgp, and the constant current Idata from the constant current source $\mathbf{950}_{nm}$ is caused to flow through the drive TFT $\mathbf{900}_{nm}$ by allowing the p-type TFT $\mathbf{940}_{nm}$ and the switch TFT $\mathbf{910}_{nm}$ to be turned ON by a gate voltage Vsel.

Voltage corresponding to the constant current Idata is retained by the storage capacitor $\mathbf{920}_{nm}$ until the current flowing through the drive TFT $\mathbf{900}_{nm}$ becomes stable.

The p-type TFT $\mathbf{940}_{nm}$ and the switch TFT $\mathbf{910}_{nm}$ are turned OFF by the gate voltage Vsel and the p-type TFT $\mathbf{960}_{nm}$ is turned ON by the gate voltage Vgp, whereby the power supply line is electrically connected to the drive TFT $\mathbf{900}_{nm}$ and the organic LED $\mathbf{930}_{nm}$. Current almost equal to or in an amount corresponding to the constant current Idata is supplied to the organic LED $\mathbf{930}_{nm}$ by the voltage retained by the storage capacitor $\mathbf{920}_{nm}$.

In this organic EL element, the scanning electrode may be used as an electrode to which the gate voltage Vsel is applied, and the signal electrode may be used as a data line.

The organic LED may have a structure in which a light-emitting layer is provided on a transparent anode (ITO) and a metal cathode is provided on the light-emitting layer, or a structure in which a light-emitting layer, a light-transmitting cathode, and a transparent seal are provided on a metal anode. The organic LED is not limited by the element structure.

A general-purpose signal driver IC for organic EL panels can be provided by forming a signal driver IC which drives an organic EL panel including organic EL elements as described above.

In addition to the organic EL element, the present invention may be applied to the case of driving a display panel in which a micro-mirror device (MMD) is provided as a display element.

The present invention is not limited to the above-described embodiment. Various modifications and variations are possible within the spirit and scope of the present invention. For example, the present invention may be applied to a plasma display device.

What is claimed is:

1. A display driver circuit for driving a signal electrode based on grayscale data of (a+b) bits (a and b are positive integers), the display driver circuit comprising:

a precharge circuit which sets an output electrode electrically connected to the signal electrode at a precharge voltage in a first period within a drive period;

a voltage select circuit which sets the output electrode which has been set at the precharge voltage at a reference voltage based on the grayscale data; and a drive voltage adjusting circuit which adjusts a voltage of the output electrode by using the grayscale data, the output voltage having been set at the reference voltage, wherein:

the drive voltage adjusting circuit includes a first transistor and a second transistor;

a source terminal and a drain terminal of the first transistor are respectively connected to a first power supply line to which a first power supply voltage is supplied and the output electrode;

a source terminal and a drain terminal of the second transistor are respectively connected to a second power supply line to which a second power supply voltage is supplied and the output electrode; and a gate signal is applied to a gate electrode of one of the first and second transistors, the gate signal having a pulse width determined based on low order "b" bit(s) or the low order "b" bit(s) and at least part of high order "a" bit(s) in the grayscale data of (a+b) bits.

2. The display driver circuit as defined in claim 1, wherein:

the drive voltage adjusting circuit includes at least one transistor for gamma correction;

a source terminal and a drain terminal of the transistor for gamma correction are respectively connected to a signal line to which a gamma-corrected voltage is supplied and the output electrode; and a gate signal generated based on the grayscale data of (a+b) bits is applied to a gate electrode of the transistor for gamma correction.

3. The display driver circuit as defined in claim 2, wherein:

a pixel electrode is connected to the signal electrode which is electrically connected to the output electrode, through a pixel switch element corresponding to a pixel; and the precharge voltage is a voltage in the same phase as a voltage of an electrode opposite to the pixel electrode.

4. The display driver circuit as defined in claim 1, wherein:

the drive voltage adjusting circuit includes the first transistor, the second transistor and at least one transistor for gamma correction;

a source terminal and a drain terminal of the transistor for gamma correction are respectively connected to a signal line to which a gamma-corrected voltage is supplied and the output electrode; and another gate signal generated based on the grayscale data of (a+b) bits is applied to a gate electrode of the transistor for gamma correction.

5. The display driver circuit as defined in claim 4, wherein:

a pixel electrode is connected to the signal electrode which is electrically connected to the output electrode, through a pixel switch element corresponding to a pixel; and the precharge voltage is a voltage in the same phase as a voltage of an electrode opposite to the pixel electrode.

6. The display driver circuit as defined in claim 1, wherein:

a pixel electrode is connected to the signal electrode which is electrically connected to the output electrode, through a pixel switch element corresponding to a pixel; and the precharge voltage is a voltage in the same phase as a voltage of an electrode opposite to the pixel electrode.

7. A display panel comprising:

pixels specified by a plurality of scanning electrodes and a plurality of signal electrodes;

the display driver circuit as defined in claim 1 for driving the signal electrodes based on grayscale data; and a scanning electrode driver circuit which scans the scanning electrodes.

8. A display device comprising:

a display panel having pixels specified by a plurality of scanning electrodes and a plurality of signal electrodes;

the display driver circuit as defined in claim 1 for driving the signal electrodes based on grayscale data; and a scanning electrode driver circuit which scans the scanning electrodes.

9. A display driver circuit for driving a signal electrode based on grayscale data of (a+b) bits (a and b are positive integers), the display driver circuit compnsing:

a precharge circuit which sets an output electrode electrically connected to the signal electrode at a precharge voltage in a first period within a drive period;

a voltage select circuit which sets the output electrode which has been set at the precharge voltage at a reference voltage based on the grayscale data; and a drive voltage adjusting circuit which adjusts a voltage of the output electrode by using the grayscale data, the output voltage having been set at the reference voltage, wherein:

the voltage select circuit sets the output electrode at the reference voltage based on high order "a" bit(s) in the grayscale data of (a+b) bits;

the drive voltage adjusting circuit includes a first transistor and a second transistor;

a source terminal and a drain terminal of the first transistor are respectively connected to a first power supply line to which a first power supply voltage is supplied and the output electrode;

a source terminal and a drain terminal of the second transistor are respectively connected to a second power supply line to which a second power supply voltage is supplied and the output electrode; and a gate signal is applied to a gate electrode of one of the first and second transistors, the gate signal having a pulse width determined based on low order "b" bit(s) or the low order "b" bit(s) and at least part of high order "a" bit(s) in the grayscale data of(a+b) bits.

10. The display driver circuit as defined in claim 9, wherein:

the drive voltage adjusting circuit includes at least one transistor for gamma correction;

a source terminal and a drain terminal of the transistor for gamma correction are respectively connected to a signal line to which a gamma-corrected voltage is supplied and the output electrode; and a gate signal generated based on the grayscale data of (a+b) bits is applied to a gate electrode of the transistor for gamma correction.

11. The display driver circuit as defined in claim 10, wherein:

a pixel electrode is connected to the signal electrode which is electrically connected to the output electrode, through a pixel switch element corresponding to a pixel; and the precharge voltage is a voltage in the same phase as a voltage of an electrode opposite to the pixel electrode.

12. The display driver circuit as defined in claim 9, wherein:

a pixel electrode is connected to the signal electrode which is electrically connected to the output electrode, through a pixel switch element corresponding to a pixel; and the precharge voltage is a voltage in the same phase as a voltage of an electrode opposite to the pixel electrode.

13. A display drive method for driving a signal electrode based on grayscale data of (a+b) bits (a and b are positive integers), the display drive method comprising:

setting an output electrode electrically connected to the signal electrode at a precharge voltage in a first period within a drive period;

setting the output electrode which has been set at the precharge voltage at a reference voltage based on the grayscale data; and adjusting a voltage of the output electrode by using the grayscale data, the output electrode having been set at the reference voltage, wherein:

a first power supply voltage and a second power supply voltage are respectively supplied to a first power supply line and a second power supply line; and one of the first and second power supply lines is electrically connected to the output electrode which has been set at the reference voltage during a period of a pulse width determined based on low order "b" bit(s) or the low order "b" bit(s) and at least part of high order "a" bit(s) in the grayscale data of (a+b) bits.

14. The display drive method as defined in claim 13, wherein the output electrode which has been set at the reference voltage is set at a gamma-corrected voltage based on the grayscale data of (a+b) bits.

15. The display drive method as defined in claim 13, wherein the output electrode which has been set at the reference voltage is set at a gamma-corrected voltage based on the grayscale data of (a+b) bits.

16. A display drive method for driving a signal electrode based on grayscale data of (a+b) bits (a and b are positive integers), the display drive method comprising:

setting an output electrode electrically connected to the signal electrode at a precharge voltage in a first period within a drive period;

setting the output electrode which has been set at the precharge voltage at a reference voltage based on the grayscale data;

adjusting a voltage of the output electrode by using the grayscale data, the output electrode having been set at the reference voltage, wherein the output electrode is set at the reference voltage based on high order "a" bit(s) in the grayscale data of (a+b) bits, and wherein a first power supply voltage and a second power supply voltage are respectively supplied to a first power supply line and a second power supply line; and one of the first and second power supply lines is electrically connected to the output electrode which has been set at the reference voltage during a period of a pulse width determined based on low order "b" bit(s) or the low order "b" bit(s) and at least part of high order "a" bit(s) in the grayscale data of (a+b) bits.

17. The display drive method as defined in claim 16, wherein the output electrode which has been set at the reference voltage is set at a gamma-corrected voltage based on the grayscale data of (a+b) bits.

18. The display drive method as defined in claim 16, wherein the output electrode which has been set at the reference voltage is set at a gamma-corrected voltage based on the grayscale data of (a+b) bits.

* * * * *